US009896881B2

(12) United States Patent
Cheng

(10) Patent No.: US 9,896,881 B2
(45) Date of Patent: Feb. 20, 2018

(54) FIXING ASSEMBLY FOR A SHADING BODY

(71) Applicant: Li-Ming Cheng, Kaohsiung (TW)

(72) Inventor: Li-Ming Cheng, Kaohsiung (TW)

( * ) Notice: Subject to any disclaimer, the term of this patent is extended or adjusted under 35 U.S.C. 154(b) by 49 days.

(21) Appl. No.: 14/935,496

(22) Filed: Nov. 9, 2015

(65) Prior Publication Data

US 2017/0130525 A1 May 11, 2017

(51) Int. Cl.

| | |
|---|---|
| ***E06B 3/00*** | (2006.01) |
| ***E06B 9/323*** | (2006.01) |
| ***A47H 1/022*** | (2006.01) |
| *A47H 1/02* | (2006.01) |

(52) U.S. Cl.

CPC ..... *E06B 9/323* (2013.01); *A47H 1/022* (2013.01); *A47H 2001/0215* (2013.01)

(58) Field of Classification Search

CPC ... E06B 9/266; E06B 9/30; E06B 9/38; E06B 9/305; E06B 9/307; E06B 2009/2622; E06B 2009/2625; E06B 2009/2627; A47H 1/00; A47H 1/02; A47H 1/022; A47H 1/10; A47H 1/102; A47H 1/122; A47H 1/142; A47H 1/14

USPC ..... 160/368.1, 323.1, 324, 325, 326, 170, 160/171, 84.01, 84.04, 84.05, 168.1 R; 248/65, 74.1, 74.2, 251–273

See application file for complete search history.

(56) References Cited

U.S. PATENT DOCUMENTS 869,328 A * 10/1907 Pearson ..... A47H 1/142 248/262
2,555,709 A * 6/1951 Sherwood ..... E06B 9/306 160/168.1 R
2,721,609 A * 10/1955 Rutledge ..... E06B 9/307 160/177 R
2,925,982 A * 2/1960 Moser ..... F16B 2/241 174/DIG. 2
2,955,790 A * 10/1960 Sylvester ..... H02G 5/025 174/171
3,333,905 A * 8/1967 Hennequin ..... E06B 9/307 160/177 R
3,530,634 A * 9/1970 Adams ..... E04C 5/20 174/146
3,918,513 A * 11/1975 Englund ..... E06B 9/307 160/176.1 R
4,224,974 A * 9/1980 Anderson ..... E06B 9/323 160/178.1 R (Continued)

FOREIGN PATENT DOCUMENTS

EP 0373787 A1 * 6/1990 ..... E06B 9/307

*Primary Examiner* — Katherine W Mitchell
*Assistant Examiner* — Johnnie A. Shablack
(74) *Attorney, Agent, or Firm* — Alan D. Kamrath; Kamrath IP Lawfirm, P.A.

(57) ABSTRACT

A fixing assembly for a shading body includes a fixing rail, an elastic fastener and an extendable rod. A slit is arranged at a top side of the fixing rail. The elastic fastener includes a rod-retaining section and two engaging sections. The rod-retaining section is arranged between the two engaging sections. The elastic fastener is engaged with the fixing rail by the two engaging sections. The rod-retaining section is received in the fixing rail and has two positioning portions. The extendable rod is inserted in the rod-retaining section of the elastic fastener through the slit. The two positioning portions abut against an outer periphery of the extendable rod.

7 Claims, 19 Drawing Sheets

(56) References Cited

U.S. PATENT DOCUMENTS 4,333,510 A * 6/1982 Fox ..... E06B 9/307 160/177 R
4,457,351 A * 7/1984 Anderson ..... E06B 9/307 160/178.1 R
4,637,445 A * 1/1987 Nilsson ..... E06B 9/32 160/168.1 R
4,643,238 A * 2/1987 Tachikawa ..... E06B 9/307 160/168.1 R
4,697,629 A * 10/1987 Anderson ..... E06B 9/307 160/177 R
5,178,200 A * 1/1993 Hagen ..... E06B 9/264 160/107
5,341,865 A * 8/1994 Fraser ..... E06B 9/307 160/176.1 R
5,533,560 A * 7/1996 Morris ..... E06B 9/323 160/178.1 R
5,538,066 A * 7/1996 Liu ..... E06B 9/30 160/173 R
5,628,356 A * 5/1997 Marocco ..... E06B 9/308 160/170
5,638,882 A * 6/1997 Morris ..... E06B 9/308 160/176.1 R
RE35,926 E * 10/1998 Hagen ..... E06B 9/308 160/107
6,032,716 A * 3/2000 Mattey ..... E06B 9/322 160/176.1 R
6,095,228 A * 8/2000 Liu ..... E06B 9/307 160/173 R
D438,045 S * 2/2001 Liu ..... D6/580
6,189,596 B1 * 2/2001 Chen ..... E06B 9/303 160/176.1 R
6,216,889 B1 * 4/2001 Chang ..... A47H 1/122 211/105.1
6,302,182 B1 * 10/2001 Anderson ..... E06B 9/322 160/177 R
6,354,543 B1 * 3/2002 Paske ..... H01P 1/00 211/85.18
6,431,247 B1 * 8/2002 Harrison, Jr. ..... E06B 9/323 160/168.1 R
6,601,636 B1 * 8/2003 Liu ..... E06B 9/322 160/177 R
6,779,763 B2 * 8/2004 Miura ..... F16L 3/13 248/68.1
6,941,998 B2 * 9/2005 Nien ..... E06B 9/322 160/168.1 R
7,096,918 B2 * 8/2006 Lin ..... E06B 9/322 160/171
7,143,802 B2 * 12/2006 Strand ..... E06B 9/262 160/167 R
7,174,941 B2 * 2/2007 Schroder ..... E06B 9/264 160/107
7,210,646 B2 * 5/2007 Hsu ..... B65H 75/48 160/170
7,255,150 B2 * 8/2007 Wu ..... E06B 9/388 160/168.1 R
7,258,297 B2 * 8/2007 Liu ..... E06B 9/322 160/176.1 R
7,287,569 B2 * 10/2007 Lin ..... E06B 9/303 160/170
7,493,932 B2 * 2/2009 Cheng ..... E06B 9/323 160/173 R
7,546,866 B2 * 6/2009 Strand ..... E06B 9/262 160/171
7,644,748 B2 * 1/2010 Liang ..... E06B 9/322 160/171
7,658,350 B2 * 2/2010 Bauer ..... F16L 3/223 24/458
7,913,738 B2 * 3/2011 Fraser ..... E06B 9/322 160/115
8,262,043 B2 * 9/2012 Jafari ..... H02G 3/126 174/50
8,439,316 B2 * 5/2013 Feige ..... F16L 3/13 248/71
8,485,242 B2 * 7/2013 Fraser ..... E06B 9/307 160/115
8,882,059 B2 * 11/2014 Schmidt ..... F16L 3/1041 248/56
8,919,707 B2 * 12/2014 Lee ..... H02G 3/30 248/56
8,925,615 B2 * 1/2015 Lin ..... E06B 9/322 160/170
9,366,076 B2 * 6/2016 Hung ..... E06B 9/322
2005/0217805 A1 * 10/2005 Strand ..... E06B 9/262 160/168.1 P
2006/0021722 A1 * 2/2006 Nien ..... A47H 1/142 160/330
2006/0260765 A1 * 11/2006 Antonini ..... E06B 9/307 160/168.1 R
2007/0029051 A1 * 2/2007 Nien ..... E06B 9/322 160/84.05
2007/0039696 A1 * 2/2007 Strand ..... E06B 9/262 160/84.04
2008/0083509 A1 * 4/2008 Hsu ..... E06B 9/32 160/84.05
2008/0083512 A1 * 4/2008 Hsu ..... E06B 9/322 160/170
2008/0169068 A1 * 7/2008 Liang ..... E06B 9/38 160/178.1 R
2008/0216967 A1 * 9/2008 Liang ..... E06B 9/326 160/168.1 V
2008/0245486 A1 * 10/2008 Brown ..... A47H 1/022 160/84.01
2008/0245940 A1 * 10/2008 Brown ..... A47H 1/022 248/251
2011/0247766 A1 * 10/2011 Hu ..... E06B 9/322 160/188
2013/0312919 A1 * 11/2013 Hsu ..... E06B 9/30 160/170
2014/0048217 A1 * 2/2014 Hsu ..... E06B 9/303 160/173 R
2014/0048499 A1 * 2/2014 Hsu ..... E06B 9/322 211/45

* cited by examiner

FIXING ASSEMBLY FOR A SHADING BODY

BACKGROUND OF THE INVENTION

1. Field of the Invention

The present invention generally relates to a fixing assembly for a shading body and, more particularly, to a fixing assembly for connecting a shading body to an extendable rod of a curtain, shade, or blind for windows, doors or space division.

2. Description of the Related Art

Curtains, shades, or blinds are widely used in our daily life for adjusting the brightness of a space, protecting privacy, or preventing water from spraying everywhere. Conventionally, a curtain structure having a shading body made of cloth can be conveniently installed by penetrating an extendable rod through the shading body of the curtain structure, with two ends of the extendable rod abutting against two opposite steady surfaces facing each other. Alternatively, another conventional curtain structure is shown in FIG. 1. A curtain body 91 and a plurality of rings 92 arranged on a top edge of the curtain body 91 for an extendable rod 93 to extend through are provided. When installing the curtain body 91, the user can extend the extendable rod 93 penetrating the rings 92 and can abut two ends of the extendable rod 93 against two opposite surfaces of a window frame, door frame, walls, pillars or cabinet, with the two opposite surfaces facing each other.

However, the extendable rod and installation manner described above cannot be used along with all types of curtains, blinds, and shades. For a shading body that is not made of cloth, or a shading body that is designed to be folded or rolled up vertically (e.g. a roller shade, Roman shade, Venetian shade or honeycomb shade), an elongated rail is needed for a top part of such shading body to couple with. In installation, the rail is usually fixed adjacent to a window or a door by a bracket or a fastening member, such as a screw, for hanging said shading body. This installation manner is inconvenient, and also leaves screw holes on walls once the curtain, blind, or shade is removed, which may result in a dispute between a tenant and the landlord, which in turn thus largely decreases the possibility of the tenant to choose such shading product. As a result, the types of curtains, blinds, and shades for tenants to choose are greatly limited.

SUMMARY OF THE INVENTION

It is therefore the objective of this invention to provide a fixing assembly for a shading body that can be assembled with all types of curtains, shades or blinds, with two ends of an extendable rod abutted against two opposite surfaces of a building facing each other.

A fixing assembly for a shading body of the present invention includes a fixing rail, an elastic fastener and an extendable rod. A slit is arranged at a top side of the fixing rail. The elastic fastener includes a rod-retaining section and two engaging sections. The rod-retaining section is arranged between the two engaging sections. The elastic fastener is engaged with the fixing rail by the two engaging sections. The rod-retaining section is received in the fixing rail and has two positioning portions. The extendable rod is inserted in the rod-retaining section of the elastic fastener through the slit. The two positioning portions abut against an outer periphery of the extendable rod.

In a form shown, the elastic fastener includes an arched portion. An opening is formed at a top end of the arched portion. The arched portion forms a receiving space by the opening for receiving the extendable rod. The two positioning portions are arranged at front and rear ends of the arched portion, respectively.

In the form shown, the elastic fastener includes two opposite edges respectively located at left and right sides thereof. Each of the two positioning portions includes two rod-limiting pieces. The two rod-limiting pieces of each of the two positioning portions are bent and respectively extend from the two edges of the elastic fastener toward the receiving space. In addition, top and bottom corners of each rod-limiting piece can be round corners.

In the form shown, each of the front and rear ends of the arched portion connects with an exterior coupling part. The exterior coupling part includes a lateral wall, a first covering portion and a second covering portion. The lateral wall is connected to the arched portion and extends toward the top side of the fixing rail. The first covering portion is connected to the lateral wall and extends toward a front side or a rear side of the fixing rail. The first covering portion covers a top face of the fixing rail. The second covering portion is connected to the first covering portion and extends downwards for covering a front face or a rear face of the fixing rail.

In the form shown, an engaging portion is arranged at the lateral wall of each exterior coupling part. The engaging portion abuts against an inner face of the top side of the fixing rail.

In the form shown, each engaging portion includes two rail-abutting pieces respectively connected to the two edges of the elastic fastener. The two rail-abutting pieces are bent and extend away from the receiving space. In addition, each rail-abutting piece can be tapered downwards to form an inclined edge.

In the form shown, a rail-coupling portion is arranged at the second covering portion of each exterior coupling part. The rail-covering portion extends through an outer surface of the fixing rail into a side groove of the fixing rail.

In the form shown, a part of the second covering portion of the exterior coupling part bends toward the arched portion to form the rail-coupling portion.

In another form shown, each of the front and rear ends of the arched portion connects with an elastic piece. An engaging portion is formed by a distal end of each elastic piece away from the arched portion. The engaging portion abuts against an inner face of the top side of the fixing rail. A portion of each elastic piece bends toward the receiving space to form the positioning portion between two ends of each elastic piece.

In the other form shown, each of the front and rear ends of the arched portion connects to an exterior coupling part. The exterior coupling part includes a lateral wall, a first covering portion and a second covering portion. The lateral wall is connected to the arched portion and extends toward the top side of the fixing rail. The first covering portion is connected to the lateral wall and extends toward a front side or a rear side of the fixing rail. The first covering portion covers a top face of the fixing rail. The second covering portion is connected to the first covering portion and extends downwards for covering a front face or a rear face of the fixing rail.

In a third form shown, each of the front and rear ends of the arched portion connects to a side-abutting piece. The side-abutting piece extends toward the front side or the rear side of the fixing rail to form an abutting portion. The abutting portion abuts against an inner surface of a bottom side of the fixing rail. The arched portion is located between the engaging portion and the abutting portion.

In a fourth form shown, the rod-retaining section of the elastic fastener includes an arched portion. An opening is formed at a top end of the arched portion. The arched portion forms the two positioning portions respectively at two edges thereof adjacent to the opening and a receiving space with the opening for receiving the extendable rod.

In the fourth form shown, each engaging section includes a first abutting part, a second abutting part and a third abutting part. The first abutting part connects to the arched portion and extends toward a front side or a rear side of the fixing rail. The second abutting part connects to the first abutting part. A distal end of the second abutting part away from the first abutting part abuts against an inner surface of the top side of the fixing rail. The third abutting part connects to the positioning portion and is bent and extends toward the top side of the fixing rail. An engaging portion is formed by a distal end of the third abutting part away from the positioning portion. The engaging portion abuts against the inner surface of the top side of the fixing rail.

In the fourth form shown, the first abutting parts of the two engaging sections extend from a bottom end of the arched portion. The first abutting parts of the two engaging sections connect to each other and abut against an inner surface of a bottom side of the fixing rail.

In the fourth form shown, each engaging section further includes a supporting piece arranged between the first abutting part and the third abutting part. Two ends of the supporting piece respectively connect to the arched portion and the second abutting part.

In the form shown, the extendable rod includes an outer tube, an inner tube and a sleeve. An end portion of the inner tube is received in the outer tube. The sleeve is fit around the inner tube.

According to the above, the fixing assembly for a shading body of the present invention can be assembled with all types of curtains, shades and blinds, and can be installed between two opposite surfaces facing each other of a building by the extendable rod. The installation manner is convenient, and will not leave screw holes on walls once the curtain, blind, or shade is removed. Therefore, such a fixing assembly for a shading body is suitable for a tenant.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
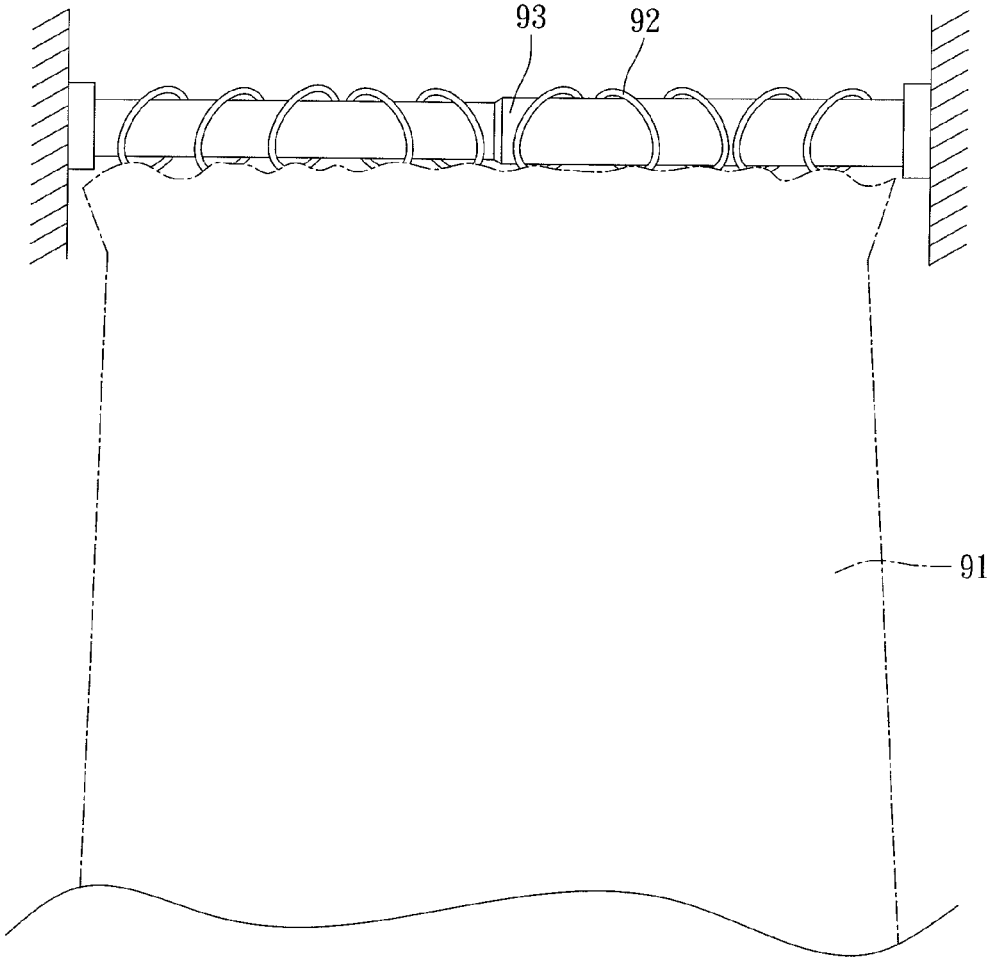
FIG. 1 PRIOR ART
FIG. 1 is a side view of a conventional fixing assembly for a shading body.

In the various figures of the drawings, the same numerals designate the same or similar parts. Furthermore, when the terms "first", "second", "third", "fourth", "inner", "outer", "top", "bottom", "front", "rear", "right", "left" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
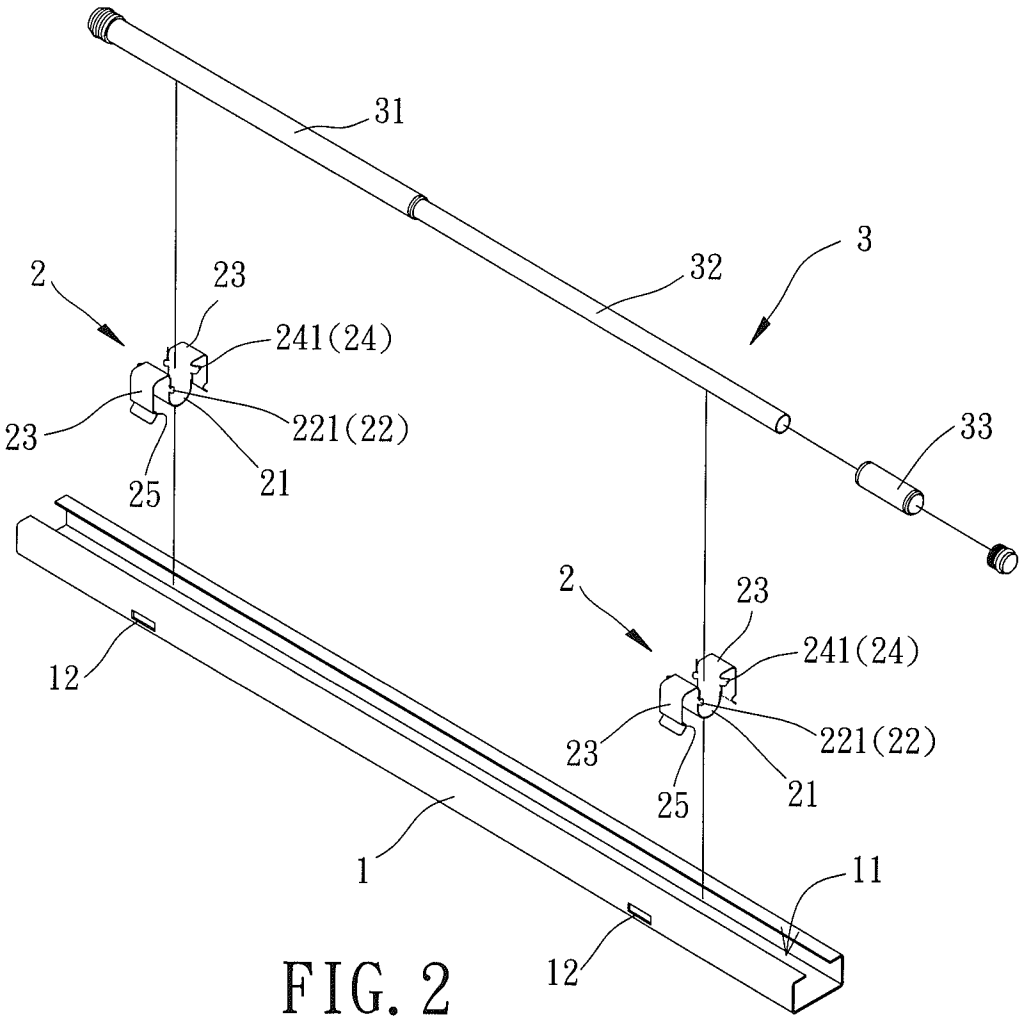
FIG. 2 is a perspective and exploded view of a fixing assembly for a shading body according to a first embodiment of the present invention.

Please refer to FIG. 2, which shows a fixing assembly for a shading body according to a first embodiment of the present invention. The fixing assembly for the shading body includes a fixing rail 1, at least one elastic fastener 2 and an extendable rod 3. The fixing rail 1 is coupled with the extendable rod 3 by the elastic fastener 2.

The terms "left", "right", "top", "bottom", "front" and "rear" used hereinafter in this specification refer to the orientation of the figures, and are relative to an exit where the fixing assembly for shading body is installed on, such as a door or window. Namely, "left" and "right" directions are relative to an axial direction of the extendable rod 3 shown in the figures. "Front" and "rear" are relative to a radial direction of the extendable rod 3 shown in the figures, which are horizontal directions when the extendable rod 3 is positioned. "Top" and "bottom" are relative to another radial direction of the extendable rod 3 shown in the figures, which are vertical directions when the extendable rod 3 is fixed.

Figure 3:
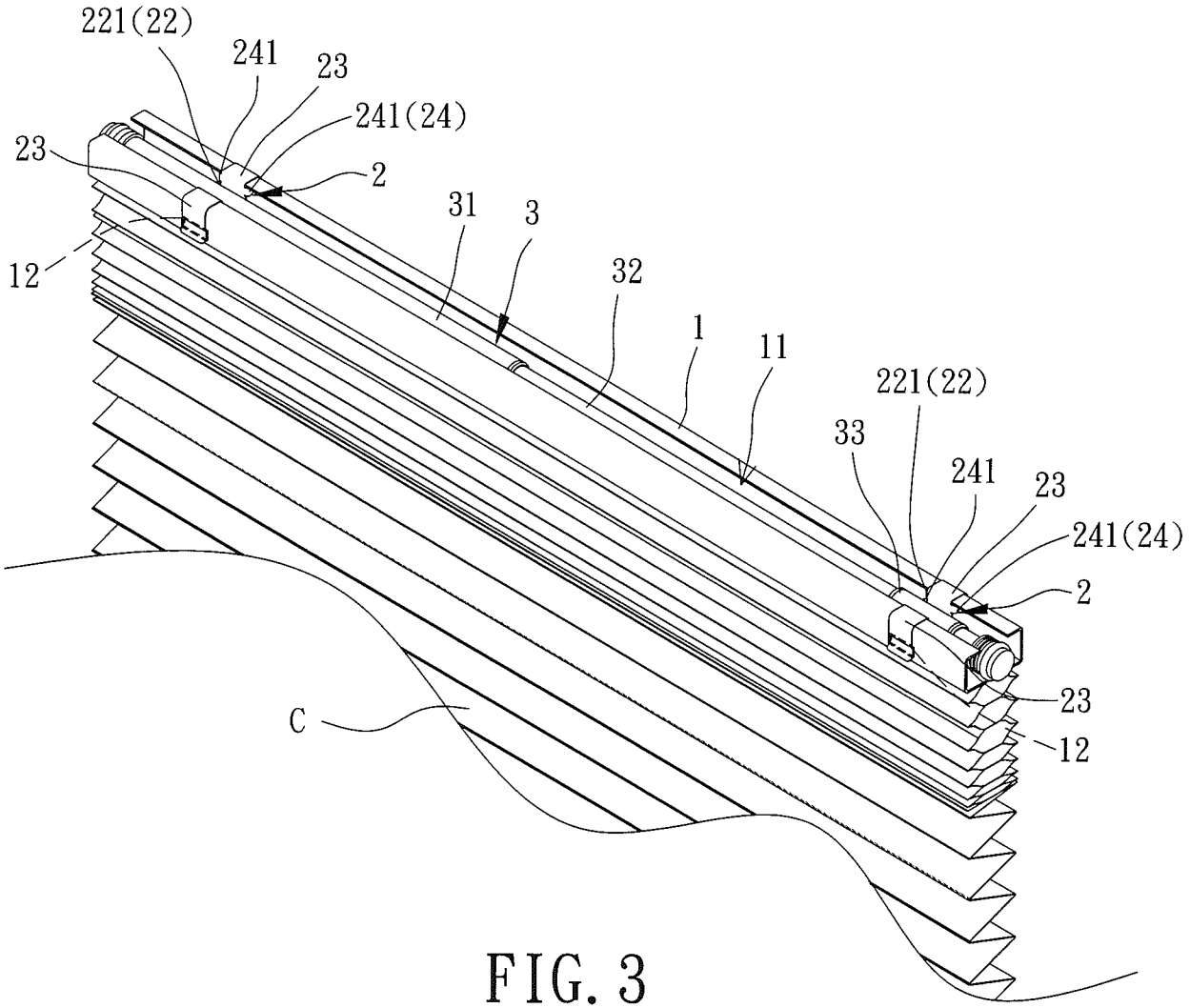
FIG. 3 is a perspective view of the fixing assembly for the shading body according to the first embodiment of the present invention, with the fixing assembly engaging with a shading body.

Please refer to FIGS. 2 and 3, the fixing rail 1 is hollow and includes a bottom side for a shading body "C" to couple with. The shading body "C" can be a cloth curtain, beaded curtain, roller shade, Roman shade, Venetian shade or honeycomb shade. As shown in FIG. 3, the shading body "C" in this embodiment is a honeycomb shade, but is not thus limited. A slit 11 is formed at a top side of the fixing rail 1, such that an interior space of the fixing rail 1 intercommunicates with an exterior space out of the fixing rail 1 via the slit 11. As such, the extendable rod 3 can be inserted into the fixing rail 1 through the slit 11.

Figure 4:
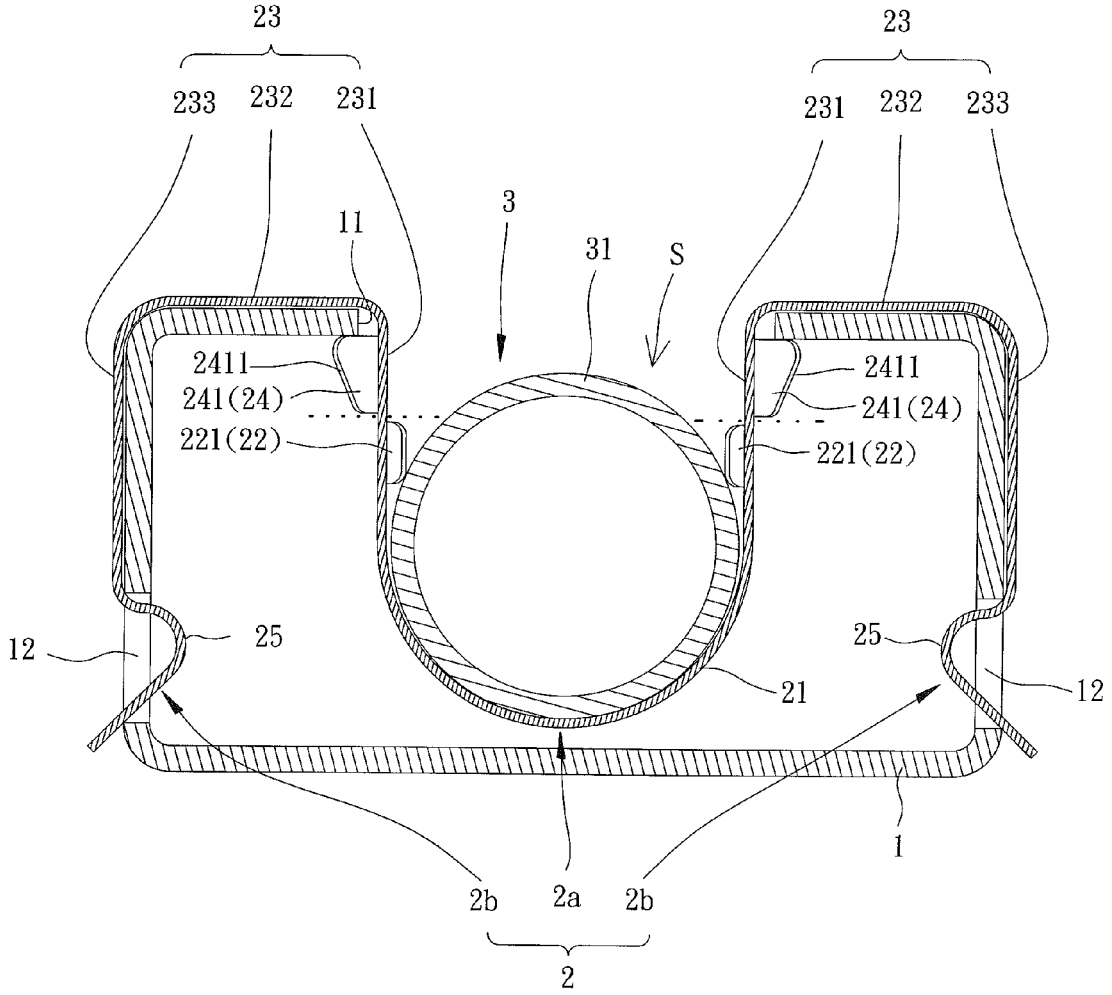
FIG. 4 is a side, cross sectional view of the fixing assembly for the shading body according to the first embodiment of the present invention which is sectioned at an outer tube thereof.

The elastic fastener 2 can be in any structure that is capable of engaging with the fixing rail 1 and the extendable rod 3. As shown in FIG. 4, the elastic fastener 2 substantially includes a rod-retaining section 2*a* and two engaging sections 2*b* (separated by the dotted line shown in the figures). The rod-retaining section 2*a* is arranged between the two engaging sections 2*b*. The elastic fastener 2 is engaged with the fixing rail 1 by the engaging sections 2*b*, such that the rod-retaining section 2*a* is received in the fixing rail 1. In addition, the extendable rod 3 can be engaged with the rod-retaining section 2*a*.

Please refer to FIG. 2, the rod-retaining section 2*a* of the elastic fastener 2 can be inserted into the fixing rail 1 through the slit 11. Alternatively, the rod-retaining section 2*a* can be inserted into the fixing rail 1 from either end of the fixing rail 1 (as described in another embodiment).

Figure 5:
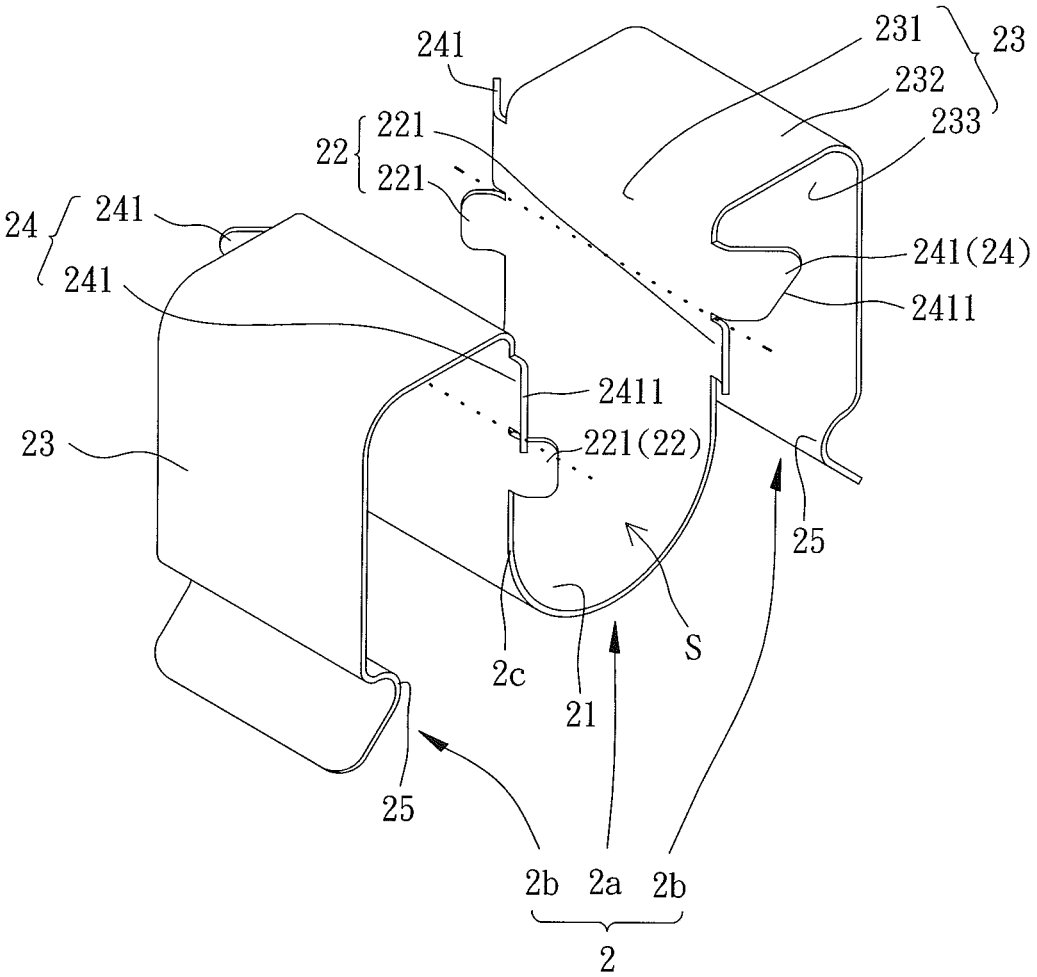
FIG. 5 is a perspective view of an elastic fastener according to the first embodiment of the present invention.

Please refer to FIGS. 4 and 5, the elastic fastener 2 includes an arched portion 21 arranged at a middle part thereof, with an opening formed at a top end of the arched portion 21. As such, the arched portion 21 forms a receiving space "S" with the opening for receiving the extendable rod 3. The elastic fastener 2 further includes two positioning portions 22 respectively arranged at front and rear ends of the arched portion 21 for engaging with and steadily positioning the extendable rod 3 received in the receiving space "S." Each positioning portion 22 includes two rod-limiting pieces 221. In this embodiment, the elastic fastener 2 has two opposite edges 2*c* respectively located at left and right sides thereof. The two rod-limiting pieces 221 are bent and respectively extend from the two edges 2*c* toward the receiving space "S."

According to the arrangement described above, the arched portion 21 and the two positioning portions 22 jointly form the rod-retaining section 2*a* of the elastic fastener 2. When placing the extendable rod 3 into the receiving space "S," the extendable rod 3 applies a force to the two positioning portions 22, such that the rod-retaining section 2*a* is expanded and deforms elastically. The rod-retaining section 2*a* returns to its original shape after the extendable rod 3 passes through the two positioning portions 22 and is steadily received in the receiving space "S." Thus, the rod-retaining section 2*a* is securely engaged with an outer periphery of the extendable rod 3 by the two positioning portions 22. Preferably, top and bottom corners of each rod-limiting piece 221 are round corners, so that the extendable rod 3 can be smoothly inserted into the receiving space "S" due to said round top corners. On the other hand, with the round bottom corners, high tension which occurred between the rod-limiting pieces 221 and the extendable rod 3 is prevented.

Each of the front and rear ends of the arched portion 21 connects with an exterior coupling part 23. Each exterior coupling part 23 includes a lateral wall 231, a first covering portion 232 and a second covering portion 233. The lateral wall 231 is connected to the arched portion 21 and extends toward the top side of the fixing rail 1. The first covering portion 232 is connected to the lateral wall 231 and extends toward the front side or the rear side of the fixing rail 1, with the first covering portions 232 of the two exterior coupling parts 23 extending backwards to each other. In addition, the first covering portion 232 covers a top face of the fixing rail 1. The second covering portion 233 is connected to the first covering portion 232 and extends downwards for covering a front face or a rear face of the fixing rail 1. Besides, the elastic fastener 2 can further include an engaging portion 24, a rail-coupling portion 25, or both on each exterior coupling part 23. The engaging portion 24 is arranged at an end of the exterior coupling part 23 connecting to the rod-retaining section 2*a*, and the rail-coupling portion 25 is arranged at a distal end of the exterior coupling part 23 away from the rod-retaining section 2*a*. Accordingly, the elastic fastener 2 can be securely engaged with the fixing rail 1 by the engaging portion 24 abutting against an inner face of the top side of the fixing rail 1, or by the rail-coupling portion 25 extended through an outer surface of the fixing rail 1 into a side groove 12 of the fixing rail 1.

In this embodiment, the engaging portion 24 is arranged on the lateral wall 231 of the exterior coupling part 23. Each engaging portion 24 has two rail-abutting pieces 241 respectively connected to the two edges 2*c*. The two rail-abutting pieces 241 are bent and extend away from the receiving space "S." The rail-coupling portion 25 can be formed by a part of the second covering portion 233 of the exterior coupling part 23, which bends toward the arched portion 21.

As described above, the engaging section 2*b* of the elastic fastener 2 can be formed by the exterior coupling part 23 and the engaging portion 24. When inserting the rod-retaining section 2*a* of the elastic fastener 2 into the fixing rail 1, the two engaging sections 2*b* deform elastically when the two engaging portions 24 pass through the slit 11. The two engaging sections 2*b* return to their original shape when the two engaging portions 24 are already received in the fixing rail 1, such that the two positioning portions 24 are able to steadily abut against the inner face of the top side of the fixing rail 1. In this way, the elastic fastener 2 is able to securely engage with the fixing rail 1. Preferably, each rail-abutting piece 241 is tapered downwards, forming an inclined edge 2411. Due to the arrangement of the inclined edge 2411, the elastic fastener 2 along with the rail-abutting piece 241 can be smoothly inserted into the fixing rail 1.

Otherwise, the engaging section 2*b* of the elastic fastener 2 can be formed by the exterior coupling part 23 and the rail-coupling portion 25. When the two exterior coupling parts 23 move downwards along the front and rear faces of the fixing rail 1, the elastic fastener 2 having the rail-coupling portions 25 is expanded and deforms elastically. When each rail-coupling portion 25 arrives the respective side groove 12, said elastic fastener 2 returns to its original shape, with the rail-coupling portions 25 extending into the side grooves 12. As a result, the elastic fastener 2 securely engages with the fixing rail 1. In the case that the elastic fastener 2 has the engaging portions 24 and rail-coupling portions 25 at the same time, the engagement between the elastic fastener 2 and the fixing rail 1 is further enhanced.

Please refer to FIG. 2, which shows that the extendable rod 3 includes an outer tube 31 and at least an inner tube 32. An end portion of the inner tube 32 is received in the outer tube 31. An entire length of the extendable rod 3 can be varied by adjusting an overlapping length of the inner tube 32 with the outer tube 31. Thus, the requirement of different lengths can be satisfied. According to this arrangement, two ends of the extendable rod 3 can securely abut against two opposite surfaces of a window frame, door frame, walls, pillars or cabinet, with the two opposite surfaces facing each other. In this embodiment, the extendable rod 3 includes only a single inner tube 32 that is received in the outer tube 31 and is able to move axially relative to the outer tube 32. However, it is not taken as a limited sense.

Figure 6:
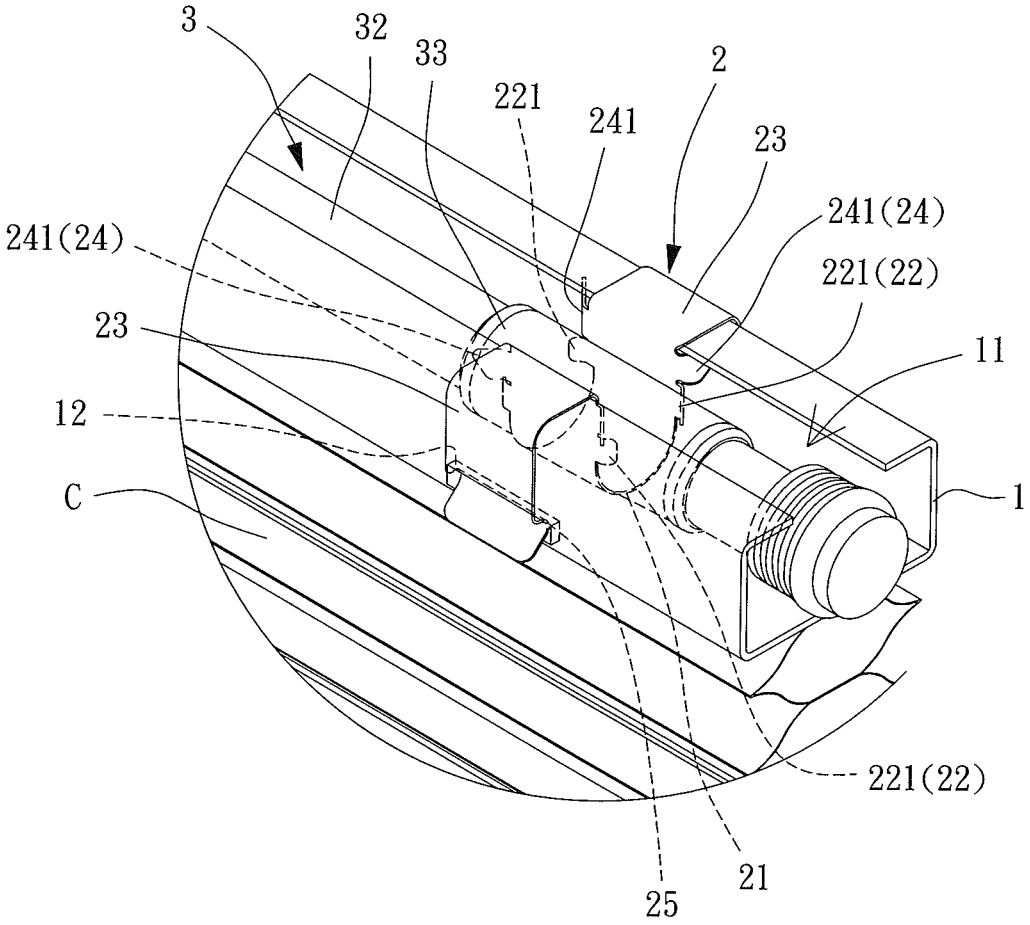
FIG. 6 is a partial, exploded view of the fixing assembly for the shading body according to the first embodiment of the present invention, with the fixing assembly engaging with a shading body.
Figure 7:
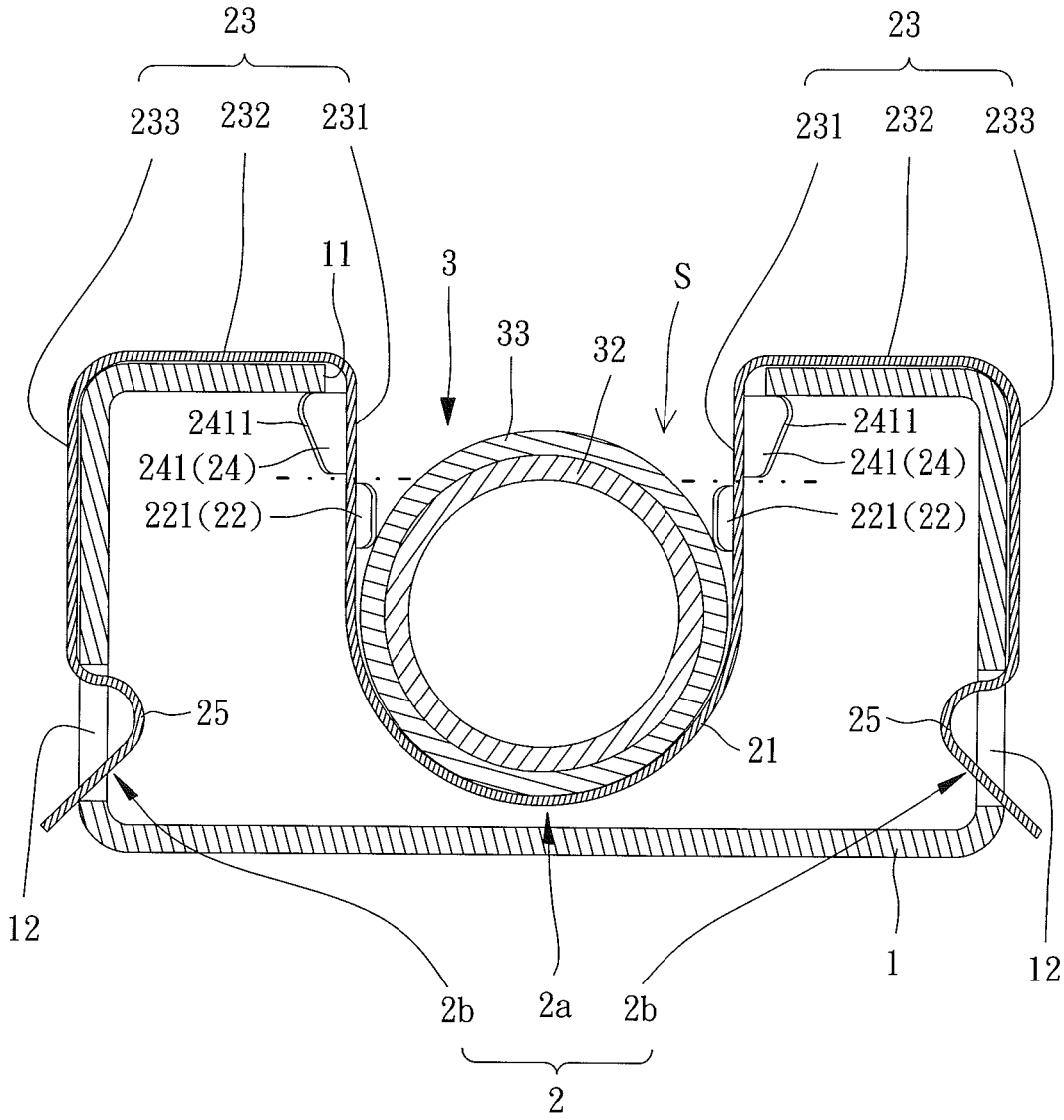
FIG. 7 is a cross sectional side view of the fixing assembly for the shading body according to the first embodiment of the present invention which is sectioned at the outer tube overlapping an inner tube.

Please refer to FIGS. 2 and 4, the extendable rod 3 is received in the rod-retaining section 2*a* of the elastic fastener 2, and both of the two positioning portions 22 abut against the outer periphery of the extendable rod 3. It is understood that since the outer tube 31 has an outer diameter larger than that of the inner tube 32, the elastic fastener 2 capable of engaging with the outer tube 31 may not be suitable for the inner tube 32 to engage with. Accordingly, the size of the elastic fastener 2, especially that of the arched portion 21, should correspond to the size of the respective tube. Alternatively, as shown in FIGS. 6 and 7, a sleeve 33 can be fit around the inner tube 32 in a position where the elastic fastener 2 engages, with an outer diameter of the sleeve 33 equal to that of the outer tube 31. Hence, all the elastic fasteners 2 can be in the same size, which can surely avoid errors due to selecting an improper-sized elastic fastener 2 and avoid the re-assembly processes resulting from the errors. Thus, convenient assembly and improved efficiency are achieved.

Please refer to FIGS. 2 and 3. When the fixing assembly for the shading body of the present invention is in use, the user can adjust the entire length of the extendable rod 3, to abut the two ends of the extendable rod 3 against two opposite surfaces of a window frame, door frame, walls, pillars or cabinet, with the two opposite surfaces facing each other. Referring to FIG. 4, the user can engage an appropriate amount of elastic fasteners 2 with the fixing rail 1 by inserting the rod-retaining section 2*a* of each elastic fastener 2 into the fixing rail 1 through the slit 11. As such, the two engaging portions 24 of the two engaging sections 2*b* are securely engaged with the inner face of the top side of the fixing rail 1, and the two rail-coupling portions 25 extend into the aligned side grooves 12. Thus, the elastic fastener 2 is securely engaged with the fixing rail 1.

Please refer to FIG. 3. Next, the user can push the fixing rail 1 along with the elastic fasteners 2 upwards from a bottom side of the extendable rod 3, to insert the extendable rod 3 into the fixing rail 1 through the slit 11. The extendable rod 3 is therefore received in the receiving space "S." As such, the two positioning portions 22 of the elastic fastener 2 securely engage with the outer periphery of the extendable rod 3. In this way, the shading body "C" coupled with the fixing rail 1 can be hung in a position by the extendable rod 3, such as a window frame, door frame, walls, pillars or a cabinet. Moreover, since the extendable rod 3 is covered by the fixing rail 1, the appearance of the fixing assembly for the shading body is simple.

Figure 8:
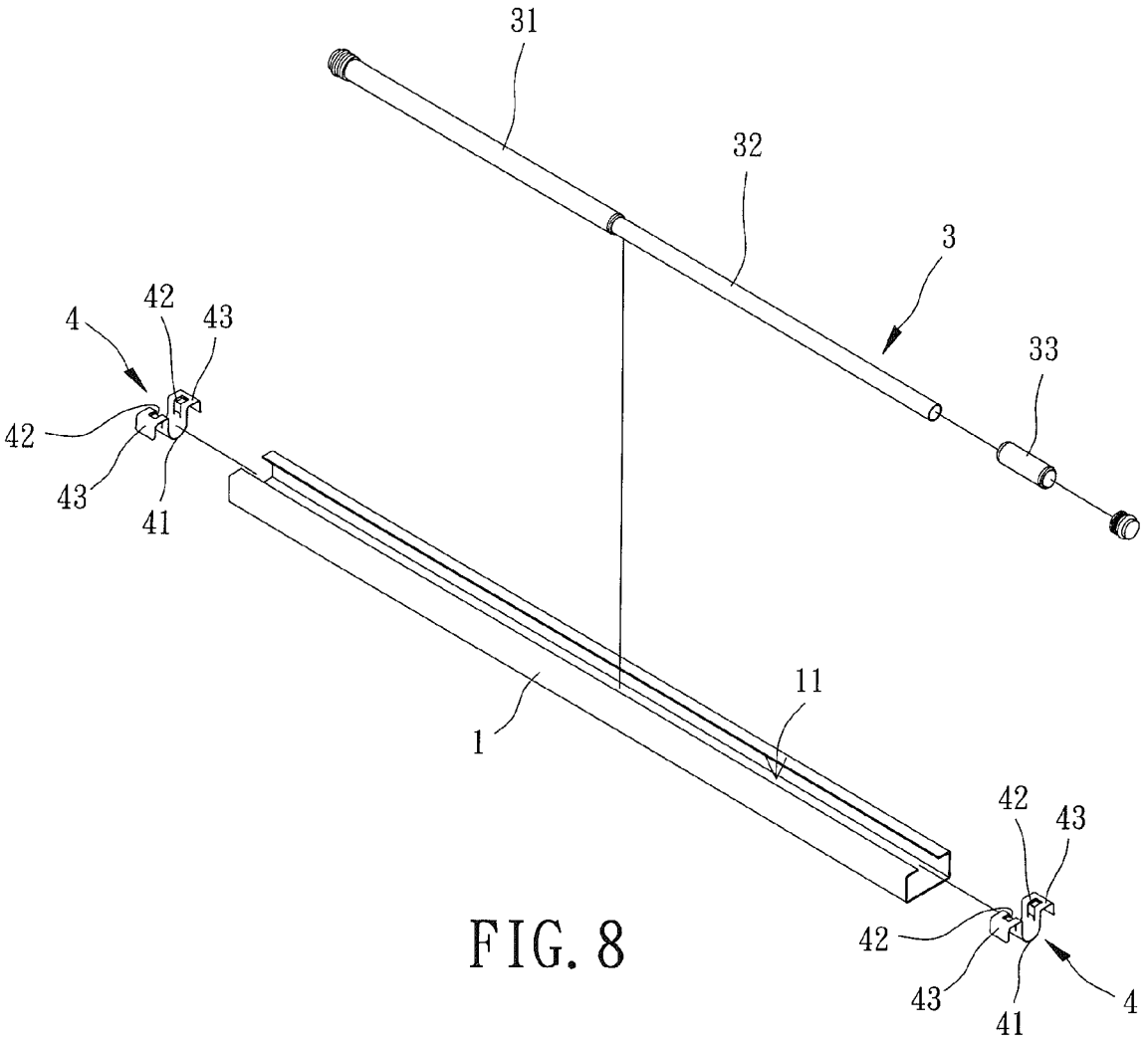
FIG. 8 is a perspective and exploded view of a fixing assembly for a shading body according to a second embodiment of the present invention.

Please refer to FIG. 8, which shows a fixing assembly for the shading body according to a second embodiment of the present invention. The second embodiment of the present invention is similar to the first embodiment, and the major difference therebetween lies in the structure of an elastic fastener 4 replacing the elastic fastener 2 of the first embodiment as well as the way to insert the elastic fastener 4 into the fixing rail 1, from a left end or a right end of the fixing rail 1.

Figure 10:
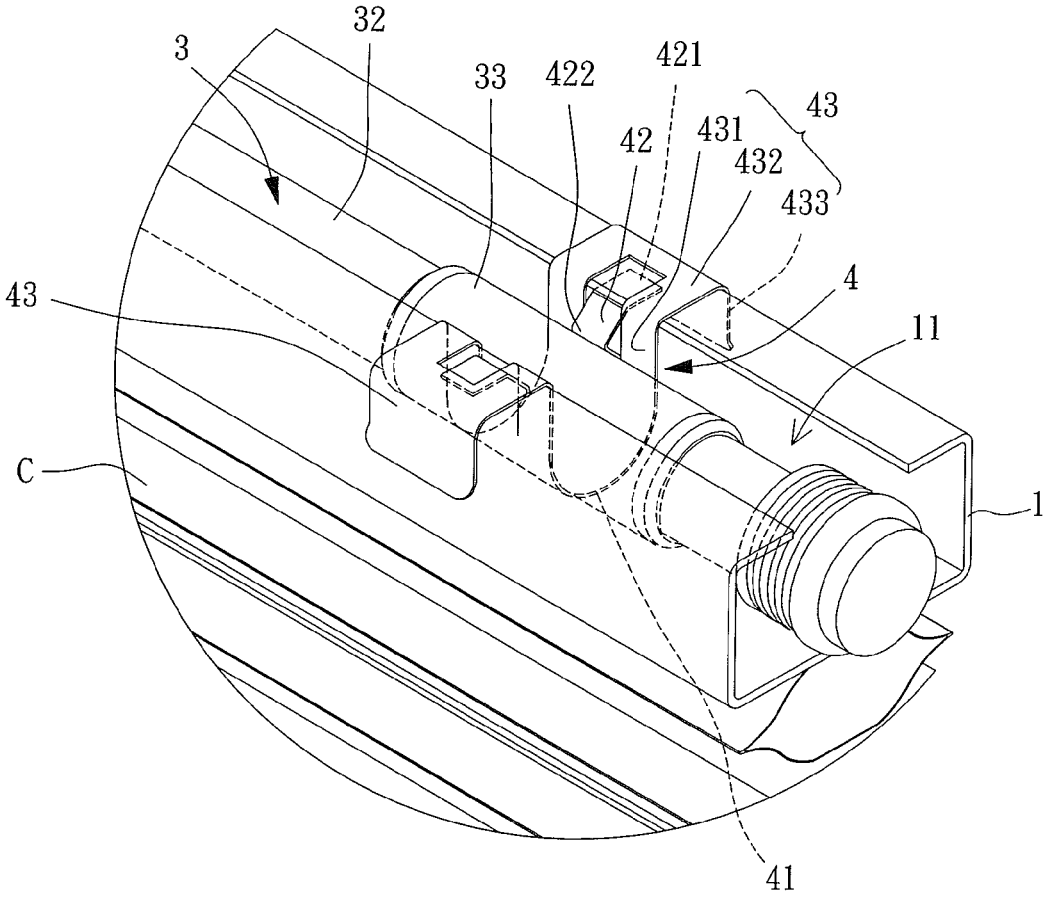
FIG. 10 is a partial, exploded view of the fixing assembly for the shading body according to the second embodiment of the present invention, with the fixing assembly engaging with a shading body.
Figure 11:
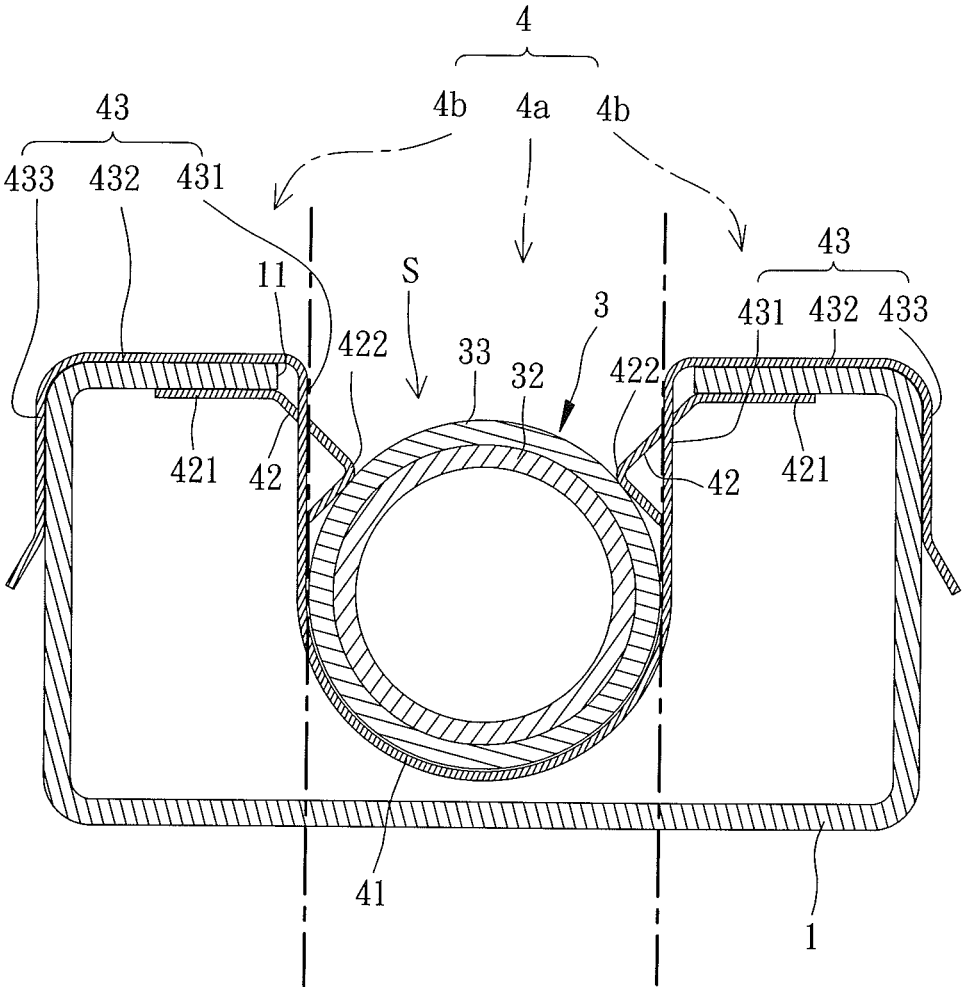
FIG. 11 is a cross sectional side view of the fixing assembly for the shading body according to the second embodiment of the present invention which is sectioned at the outer tube overlapping an inner tube.

Please refer to FIGS. 10 and 11, the elastic fastener 4 of this embodiment includes a rod-retaining section 4*a* and two engaging sections 4*b*. The rod-retaining section 4*a* is arranged between the two engaging sections 4*b*. The elastic fastener 4 is engaged with the fixing rail 1 by the engaging sections 4*b*, such that the rod-retaining section 4*a* is received in the fixing rail 1. In addition, the extendable rod 3 can be engaged with the rod-retaining section 4*a*.

Figure 9:
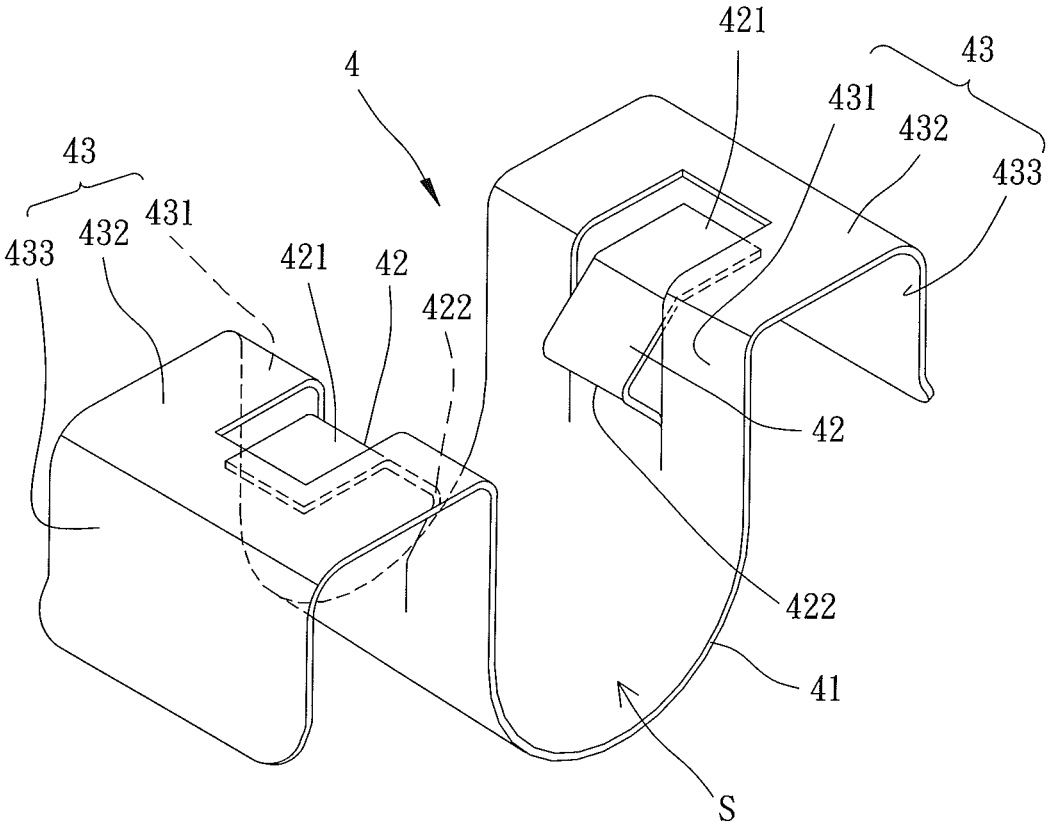
FIG. 9 is a perspective view of an elastic fastener according to the second embodiment of the present invention.

Please refer to FIGS. 9 and 11. Specifically, the elastic fastener 4 includes an arched portion 41 arranged at a middle part thereof, with an opening formed at a top end of the arched portion 41. As such, the arched portion 41 forms a receiving space "S" with the opening for receiving the extendable rod 3. Each of the front and rear ends of the arched portion 41 connects with at least one elastic piece 42. An engaging portion 421 is formed by a distal end of the elastic piece 42 that is away from the arched portion 41. The engaging portion 421 abuts against the inner face of the top side of the fixing rail 1. A portion of the elastic piece 42 bends toward the receiving space "S," forming a positioning portion 422 between two ends of the elastic piece 42. Furthermore, each of the front and rear ends of the arched portion 41 connects to at least one exterior coupling part 43. Each exterior coupling part 43 includes a lateral wall 431, a first covering portion 432 and a second covering portion 433. The lateral wall 431 is connected to the arched portion 41 and extends toward the top side of the fixing rail 1. The first covering portion 432 is connected to the lateral wall 431. The first covering portion 432 extends toward the front side of the fixing rail 1 if connecting with the lateral wall 431 extending from the front end of the arched portion 41. Otherwise, the first covering portion 432 extends toward the rear side of the fixing rail 1 if connecting with the lateral wall 431 extending from the rear end of the arched portion 41. In addition, the first covering portion 432 covers the top face of the fixing rail 1. The second covering portion 433 is connected to the first covering portion 432 and extends downwards for covering the front face or the rear face of the fixing rail 1. In this embodiment, each of the front and rear ends of the arched portion 41 connects with a single elastic piece 42 and a single exterior coupling part 43, and the elastic piece 42 is arranged at a center of the exterior coupling part 43.

According to the above, the rod-retaining section 4*a* of the elastic fastener 4 can be formed by the arched portion 41 and the positioning portion 422 of each elastic piece 42. In addition, the engaging section 4*b* of the elastic fastener 4 can be formed by the exterior coupling part 43 and the engaging portion 421 of the elastic piece 42.

Please refer to FIGS. 10 and 11. When assembling the fixing assembly of the shading body of this embodiment, the user can insert the elastic fastener 4 into the fixing rail 1 from the left end or the right end thereof, with the rod-retaining section 4*a* of the elastic fastener 4 received in the fixing rail 1. Each engaging section 4*b* of the elastic fastener 4 covers the top face of the fixing rail 1 by the first covering portion 432, and covers the front face or the rear face of the fixing rail 1 by the second covering portion 433 extended downwards. Meanwhile, the engaging portions 421 of the two elastic pieces 42 abut with the inner face of the top side of the fixing rail 1. As such, the elastic fastener 4 can be securely engaged with the fixing rail 1 by the two elastic pieces 42 and the respective exterior coupling parts 43.

Moreover, when the fixing rail 1 along with the elastic fasteners 4 are pushed upwards from the bottom side of the extendable rod 3, the extendable rod 3 is able to be inserted into the fixing rail 1 through the slit 11. During this process, the extendable rod 3 applies a force to the positioning portions 422 of the two elastic pieces 42, such that the two elastic pieces 42 are expanded and deform elastically. The two elastic pieces 42 return to their original shape after the extendable rod 3 is received in the receiving space "S," such that the positioning portions 422 of the two elastic pieces 42 can be steadily abutted against the outer periphery of the extendable rod 3.

Figure 12:
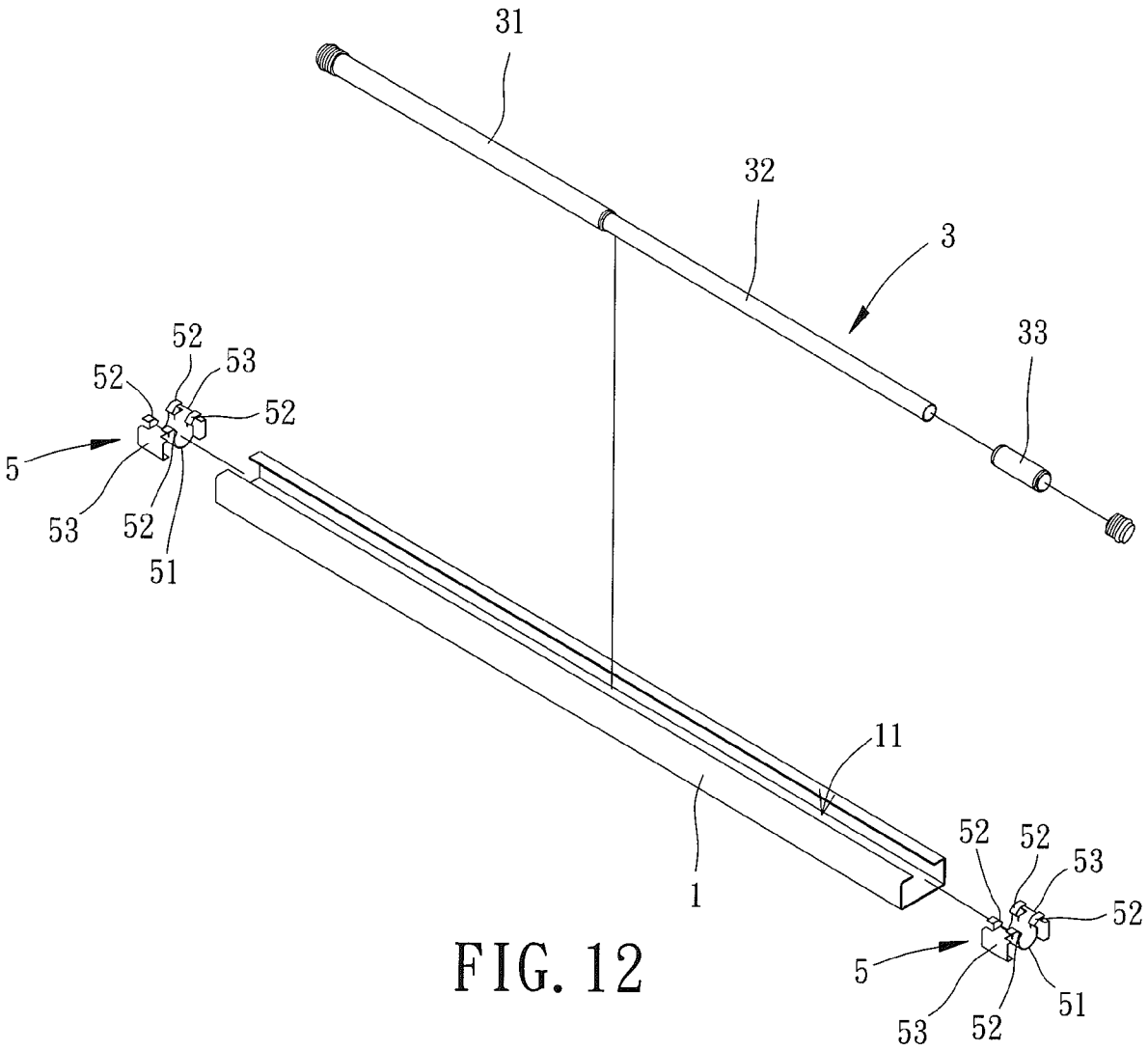
FIG. 12 is a perspective and exploded view of a fixing assembly for a shading body according to a third embodiment of the present invention.

Please refer to FIG. 12, which shows a fixing assembly for shading body according to a third embodiment of the present invention. The third embodiment of the present invention is similar to the second embodiment, and the major difference therebetween lies in the structure of an elastic fastener 5 replacing the elastic fastener 4 of the second embodiment as well as that the elastic fastener 5 is completely received in the fixing rail 1. In this arrangement, the elastic fastener 5 is not presented on the appearance of the fixing assembly for the shading body when it is assembled, such that the appearance of the fixing assembly for the shading body is simple.

Figure 14:
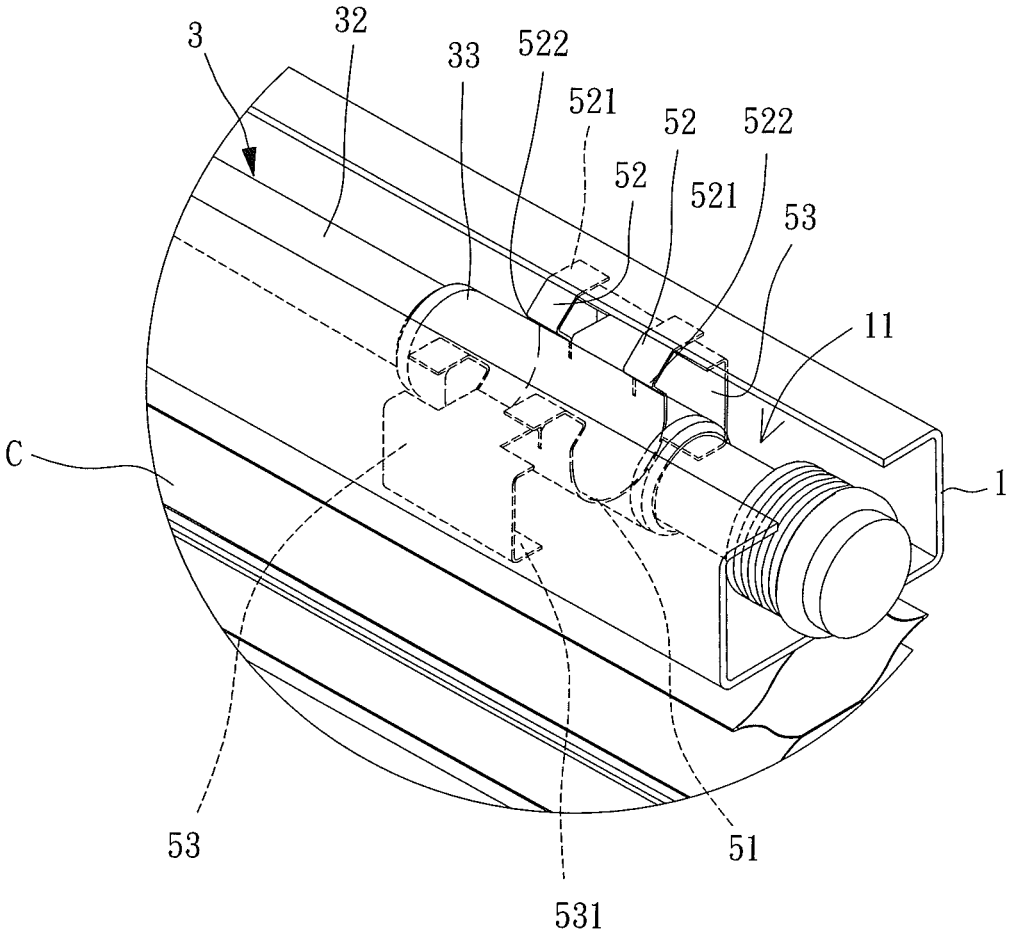
FIG. 14 is a partial, exploded view of the fixing assembly for the shading body according to the third embodiment of the present invention, with the fixing assembly engaging with a shading body.
Figure 15:
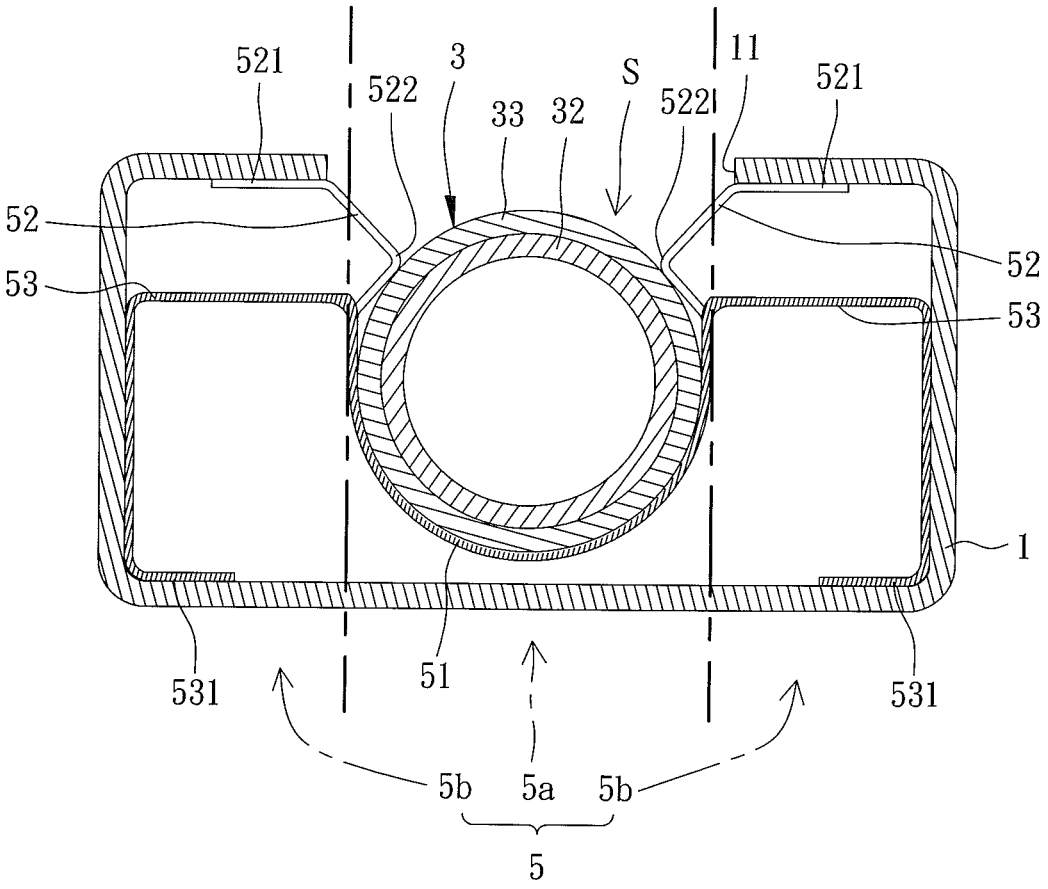
FIG. 15 is a cross sectional side view of the fixing assembly for the shading body according to the third embodiment of the present invention which is sectioned at the outer tube overlapping an inner tube.

Please refer to FIGS. 14 and 15, the elastic fastener 5 of this embodiment includes a rod-retaining section 5*a* and two engaging sections 5*b*, with the rod-retaining section 5*a* arranged between the two engaging sections 5*b*. The elastic fastener 5 is received in the fixing rail 1 and engages with the fixing rail 1 by the two engaging sections 5*b*. In addition, the elastic fastener 5 engages with the extendable rod 3 by the rod-retaining section 5*a*.

Figure 13:
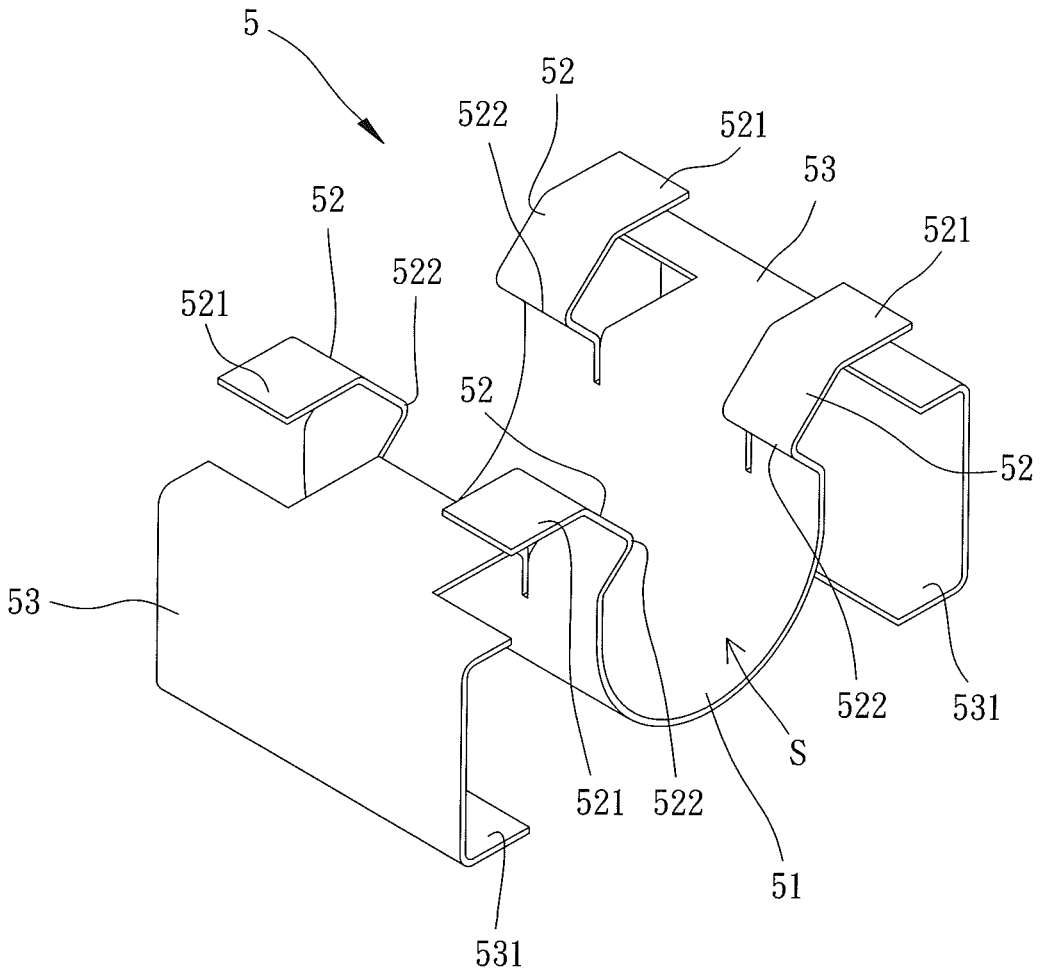
FIG. 13 is a perspective view of an elastic fastener according to the third embodiment of the present invention.

Please refer to FIGS. 13 and 15. Specifically, the elastic fastener 5 includes an arched portion 51 arranged at a middle part thereof, with an opening formed at a top end of the arched portion 51. As such, the arched portion 51 forms a receiving space "S" with the opening for receiving the extendable rod 3. Each of the front and rear ends of the arched portion 51 connects to at least one elastic piece 52. An engaging portion 521 is formed by a distal end of the elastic piece 52 that is away from the arched portion 51. The engaging portion 521 abuts against the inner face of the top side of the fixing rail 1. A portion of the elastic piece 52 bends toward the receiving space "S," forming a positioning portion 522 between two ends of the elastic piece 52. Furthermore, each of the front and rear ends of the arched portion 51 connects to at least a side-abutting piece 53. The side-abutting piece 53 extends toward the front side of the fixing rail 1 if connecting with the front end of the arched portion 51, forming an abutting portion 531. Otherwise, the side-abutting piece 53 extends toward the rear side of the fixing rail 1 if connecting with the rear end of the arched portion 51, forming the abutting portion 531. The abutting portion 531 abuts against an inner surface of the bottom side of the fixing rail 1. In a top-to-bottom direction, the arched portion 51 is located between the engaging portion 521 and the abutting portion 531, so that the arched portion 51 is spaced from the inner surface of the bottom side of the fixing rail 1. In this embodiment, each of the front and rear ends of the arched portion 51 connects with two elastic pieces 52, and the two elastic pieces 52 at either one of said ends of the arched portion 51 are respectively located adjacent to left and right edges of the elastic fastener 5, such that the side-abutting piece 53 is located between the two elastic pieces 52.

According to the arrangement described above, the rod-retaining section 5*a* of the elastic fastener 5 can be formed by the arched portion 51 and the positioning portion 522 of each elastic piece 52. In addition, the engaging section 5*b* of the elastic fastener 5 can be formed by the side-abutting piece 53 and the engaging portions 521 of the elastic pieces 52.

Please refer to FIGS. 14 and 15. When assembling the fixing assembly of the shading body of this embodiment, the user can insert the elastic fastener 5 into the fixing rail 1 from the left end or the right end thereof, such that the receiving space "S" and the strip 11 of the fixing rail 1 are aligned and intercommunicate with each other. The elastic fastener 5 abuts against the inner surface of the top side of the fixing rail 1 by the engaging portion 521 of each elastic piece 52, and abuts against the inner surface of the bottom side of the fixing rail 1 by the abutting portion 531 of each side-abutting piece 53. As such, the elastic fastener 5 securely engages with the fixing rail 1 and is located at a predetermined position in the fixing rail 1.

Moreover, when the fixing rail 1 along with the elastic fasteners 5 is pushed upwards from the bottom side of the extendable rod 3, the extendable rod 3 is able to be inserted into the fixing rail 1 through the slit 11. During this process, the extendable rod 3 applies a force to the positioning portion 522 of each elastic piece 52, such that each elastic piece 52 is expanded and deforms elastically. The elastic pieces 52 return to their original shape when the extendable rod 3 is already received in the receiving space "S," such that the positioning portions 522 of the elastic piece 52 can jointly abut against the outer periphery of the extendable rod 3, thus steadily positioning the extendable rod 3.

Figure 16:
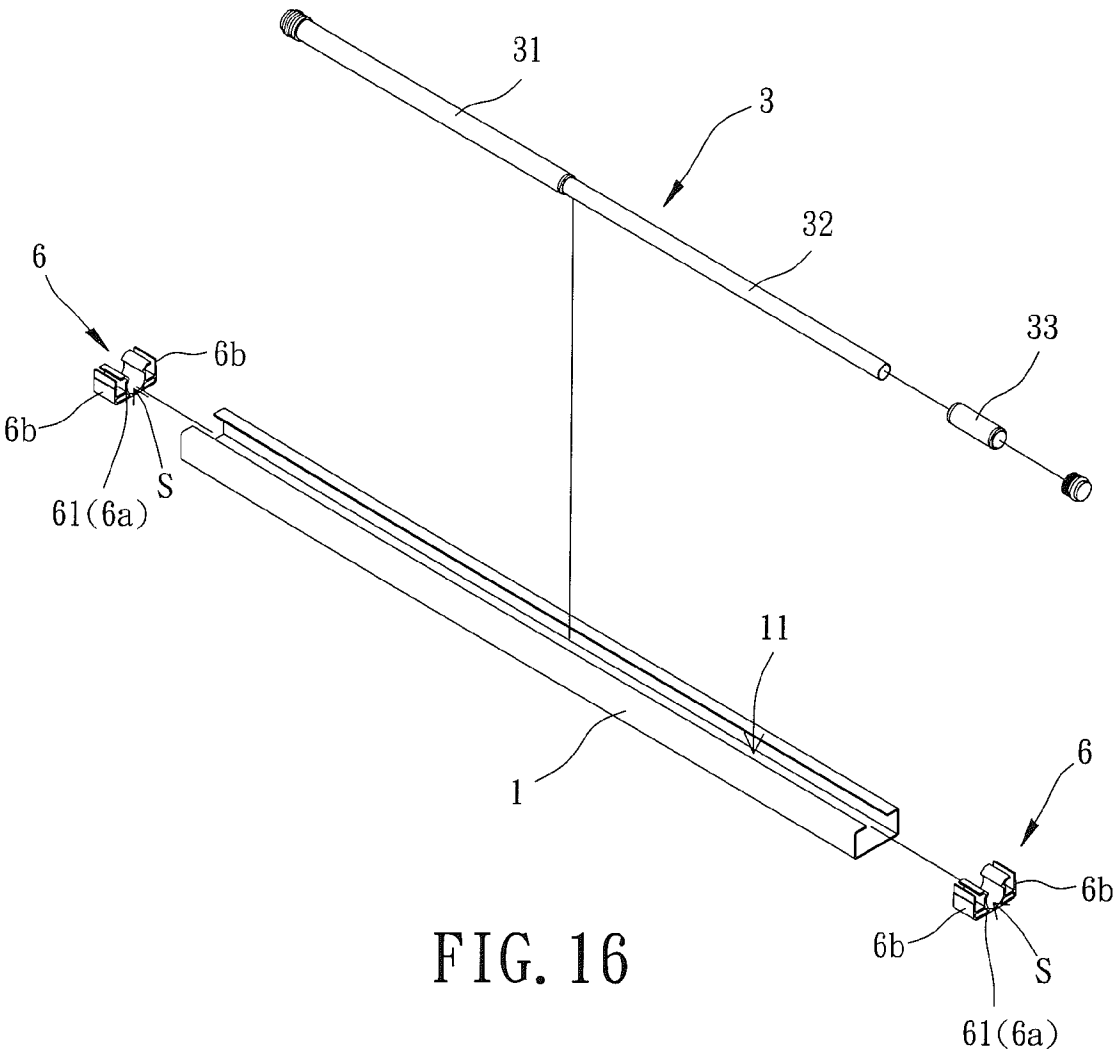
FIG. 16 is a perspective and exploded view of a fixing assembly for a shading body according to a fourth embodiment of the present invention.

Please refer to FIG. 16, which shows a fixing assembly for a shading body according to a fourth embodiment of the present invention. The fourth embodiment of the present invention is similar to the third embodiment, and the major difference therebetween lies in the structure of an elastic fastener 6 replacing the elastic fastener 5 of the third embodiment.

Figure 17:
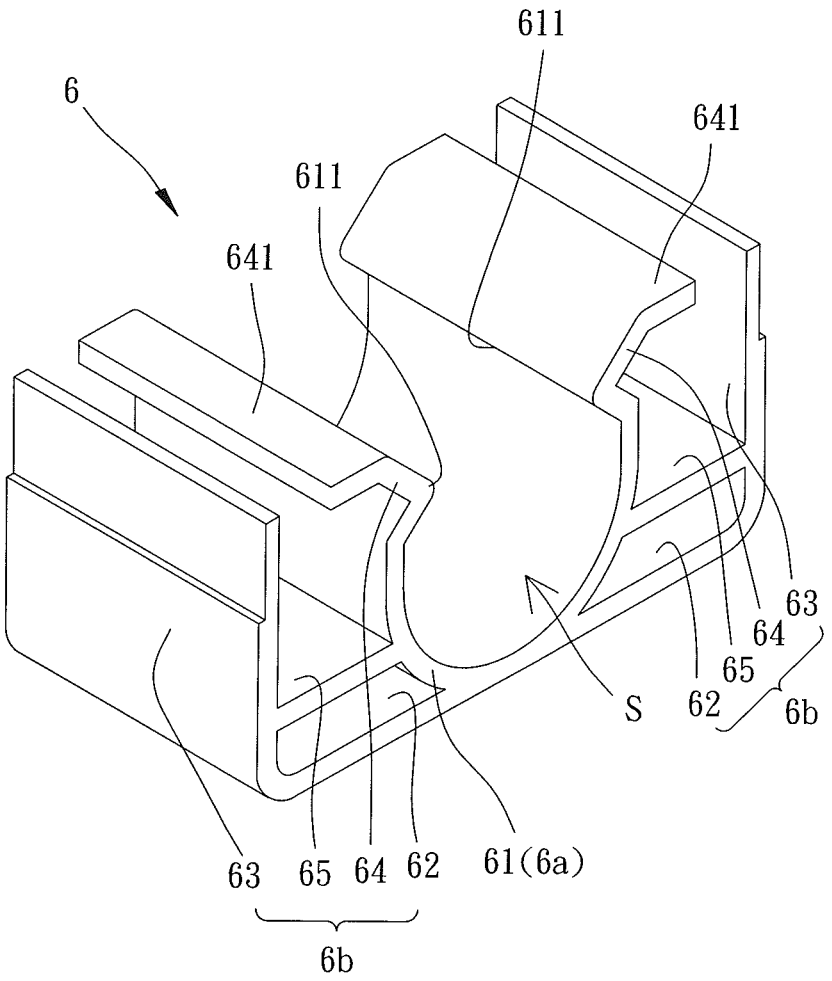
FIG. 17 is a perspective view of an elastic fastener according to the fourth embodiment of the present invention.
Figure 19:
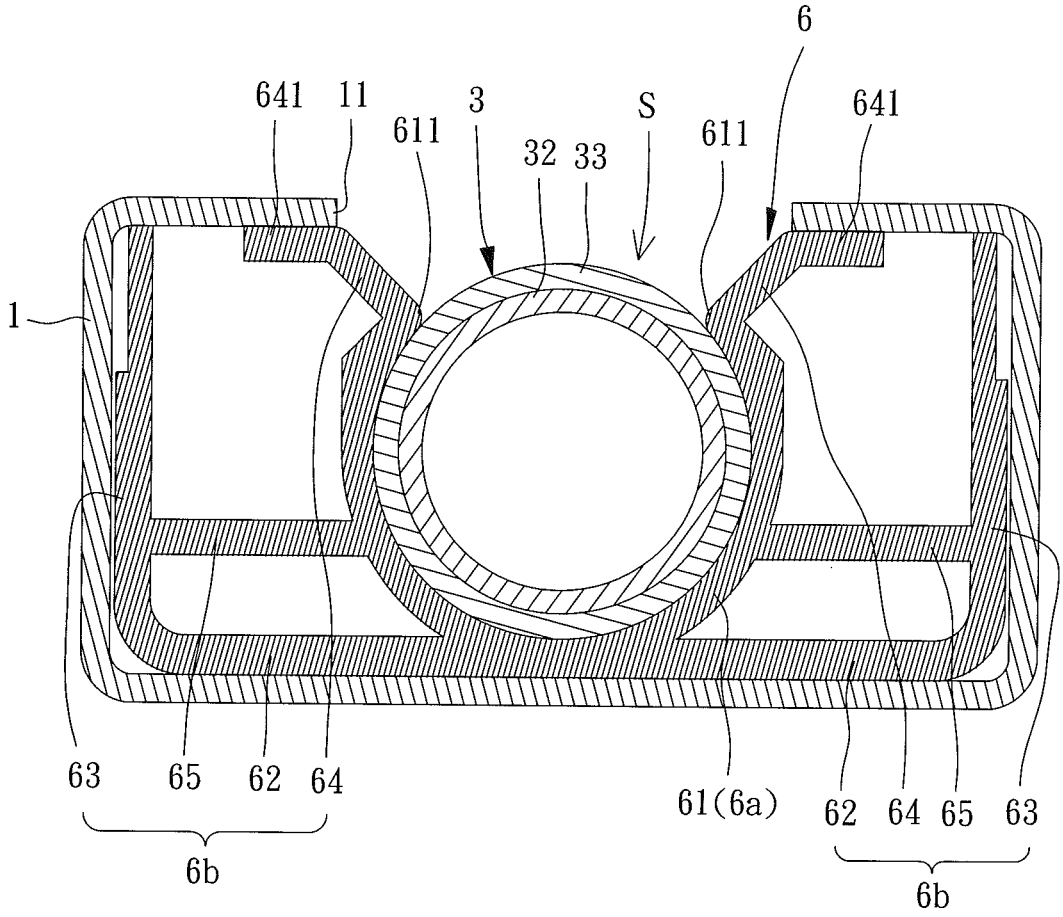
FIG. 19 is a cross sectional side view of the fixing assembly for the shading body according to the four embodiment of the present invention which is sectioned at the outer tube overlapping an inner tube.

Please refer to FIGS. 17 and 19, the elastic fastener 6 of this embodiment includes a rod-retaining section 6*a* and two engaging sections 6*b*. The rod-retaining section 6*a* is arranged between the two engaging sections 6*b*. The elastic fastener 6 is received in the fixing rail 1 and engages with the fixing rail 1 by the two engaging sections 6*b*. In addition, the elastic fastener 6 engages with the extendable rod 3 by the rod-retaining section 6*a*.

Please refer to FIGS. 17 and 19. Specifically, the rod-retaining section 6*a* of the elastic fastener 6 includes an arched portion 61, with an opening formed at a top end of the arched portion 61. The arched portion 61 forms two positioning portions 611 respectively at two edges thereof adjacent to the opening, and a receiving space "S" with the opening for receiving the extendable rod 3.

Each engaging section 6*b* includes a first abutting part 62, a second abutting part 63 and a third abutting part 64. The first abutting part 62 connects to the arched portion 61 and extends toward the front side or the rear side of the fixing rail 1, with the first abutting parts 62 of the two engaging sections 6*b* extending backwards to each other. The second abutting part 63 connects to the first abutting part 62 and extends toward the top side of the fixing rail 1, such that a distal end of the second abutting part 63 away from the first abutting part 62 abuts against the inner surface of the top side of the fixing rail 1. The third abutting part 64 connects to the positioning portion 611, and is bent and extends toward the top side of the fixing rail 1. An engaging portion 641 is formed by a distal end of the third abutting part 64 away from the positioning portion 611, and abuts against the inner surface of the top side of the fixing rail 1. The first abutting parts 62 of the two engaging sections 6*b* can extend from a bottom end of the arched portion 61, with the first abutting parts 62 of the two engaging sections 6*b* connecting to each other. As such, the structural strength of the elastic fastener 6 is enhanced.

Furthermore, each engaging section 6*b* can further include a supporting piece 65 arranged between the first abutting part 62 and the third abutting part 64, and the supporting piece 65 is adjacent to the first abutting part 62. Two ends of the supporting piece 65 connect to the arched portion 61 and the second abutting part 63, respectively. As such, the two supporting pieces 65 are able to further enhance the structural strength of the elastic fastener 6 without affecting the elasticity of the positioning portion 611 of the arched portion 61.

According to the above, the rod-retaining section 6*a* of the elastic fastener 6 can be formed by the arched portion 61, and the engaging section 6*b* of the elastic fastener 6 can be formed by the first abutting part 62, the second abutting part 63 and the third abutting part 64.

Figure 18:
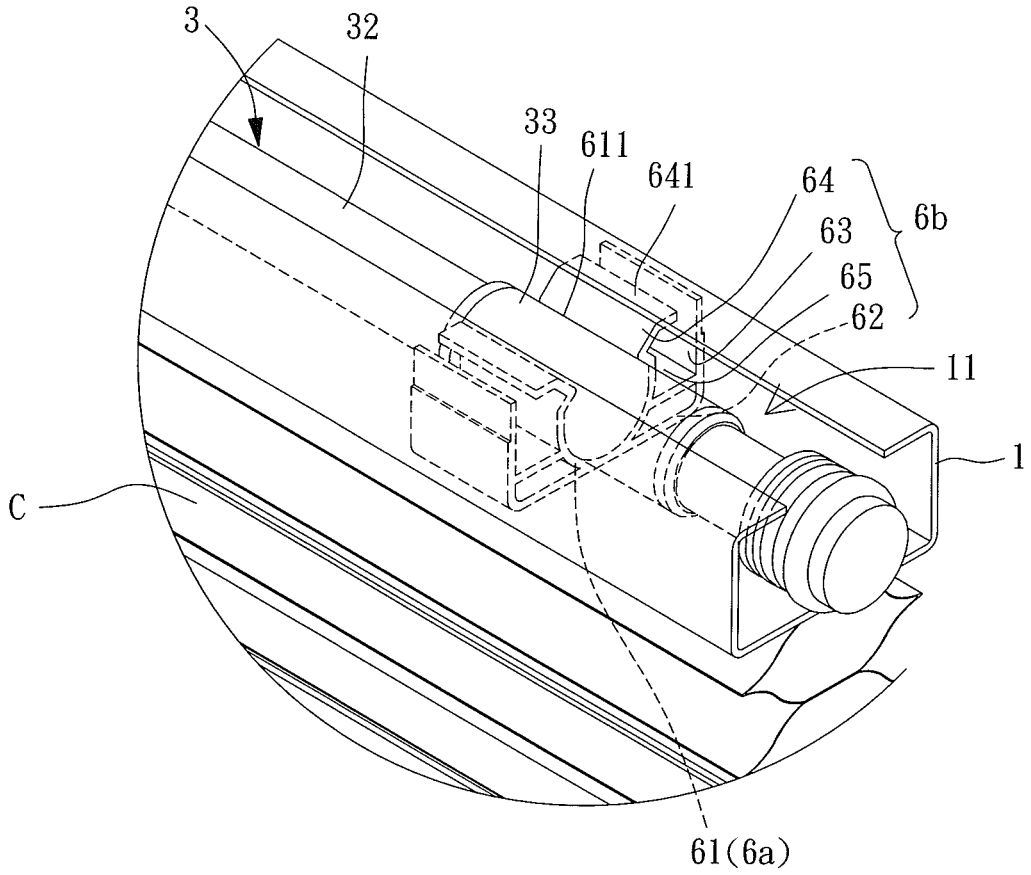
FIG. 18 is a partial, exploded view of the fixing assembly for the shading body according to the four embodiment of the present invention, with the fixing assembly engaging with a shading body.

Please refer to FIGS. 18 and 19. When assembling the fixing assembly for the shading body of this embodiment, the user can insert the elastic fastener 6 into the fixing rail 1 from the left end or the right end thereof, such that the receiving space "S" and the strip 11 of the fixing rail 1 are aligned and intercommunicate with each other. The elastic fastener 6 abuts against the inner surface of the bottom side of the fixing rail 1 by the first abutting part 62, and the distal end of the second abutting part 63 extends upwards to abut against the inner surface of the top side of the fixing rail 1. Meanwhile, the engaging portion 641 of the third abutting part 64 also abuts against the inner surface of the top side of the fixing rail 1, such that the elastic fastener 6 securely engages with the fixing rail 1 and is located at a predetermined position in the fixing rail 1.

Moreover, when the fixing rail 1 along with the elastic fasteners 6 are pushed upwards from the bottom side of the extendable rod 3, the extendable rod 3 is able to be inserted into the fixing rail 1 through the slit 11. During this process, the extendable rod 3 applies a force to the two positioning portions 611 of the arched portion 61, such that a portion of the third abutting part 64 connected to the arched portion 61 is expanded and deforms elastically. The portion of the third abutting part 64 returns to its original shape after the extendable rod 3 passes through the two positioning portions 611, such that the two positioning portions 611 of the arched portion 61 are able to steadily abut against the outer periphery of the extendable rod 3.

As a conclusion, the fixing assembly for the shading body of the present invention can be assembled with all types of curtains, shades and blinds, and can be installed between two opposite surfaces facing each other of a building by the extendable rod. The installation manner is convenient, and will not leave screw holes on walls once the curtain, blind, or shade is removed. Therefore, such a fixing assembly for a shading body is suitable for a tenant.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A fixing assembly for a shading body, comprising:

a fixing rail, wherein a slit is arranged at a top side of the fixing rail;

an elastic fastener comprising a rod-retaining section and two engaging sections, wherein the rod-retaining section is arranged between the two engaging sections, wherein the elastic fastener is engaged with the fixing rail by the two engaging sections, wherein the rod-retaining section is received in the fixing rail and has two positioning portions; and an extendable rod inserted in the rod-retaining section of the elastic fastener through the slit, wherein the two positioning portions abut against an outer periphery of the extendable rod, wherein the elastic fastener comprises an arched portion, wherein an opening is formed at a top end of the arched portion, wherein the arched portion forms a receiving space by the opening for receiving the extendable rod, wherein the two positioning portions are arranged at front and rear ends of the arched portion, respectively, wherein the elastic fastener further comprises two opposite edges respectively located at left and right sides thereof, wherein each of the two positioning portions comprises two rod-limiting pieces, wherein the two rod-limiting pieces of each of the two positioning portions are bent and respectively extend from the two opposite edges of the elastic fastener toward the receiving space, wherein each of the front and rear ends of the arched portion connects with an exterior coupling part, wherein the exterior coupling part comprises a lateral wall, a first covering portion and a second covering portion, wherein the lateral wall is connected to the arched portion and extends toward the top side of the fixing rail, wherein the first covering portion is connected to the lateral wall and extends toward a front side or a rear side of the fixing rail, wherein the first covering portion covers a top face of the fixing rail, wherein the second covering portion is connected to the first covering portion and extends downwards for covering a front face or a rear face of the fixing rail, wherein a rail-coupling portion is arranged at the second covering portion of each exterior coupling part, and wherein the rail-covering portion extends through an outer surface of the fixing rail into a side groove of the fixing rail.

2. The fixing assembly for the shading body as claimed in claim 1, wherein top and bottom corners of each of the two rod-limiting pieces are round corners.

3. The fixing assembly for the shading body as claimed in claim 1, wherein an engaging portion is arranged at the lateral wall of each exterior coupling part, and wherein the engaging portion abuts against an inner face of the top side of the fixing rail.

4. The fixing assembly for the shading body as claimed in claim 3, wherein each engaging portion comprises two rail-abutting pieces respectively connected to the two edges of the elastic fastener, and wherein the two rail-abutting pieces of each engaging portion are bent and extend away from the receiving space.

5. The fixing assembly for the shading body as claimed in claim 4, wherein each rail-abutting piece is tapered downwards to form an inclined edge.

6. The fixing assembly for the shading body as claimed in claim 1, wherein a part of the second covering portion of the exterior coupling part bends toward the arched portion to form the rail-coupling portion.

7. The fixing assembly for the shading body as claimed in claim 1, wherein the extendable rod comprises an outer tube, an inner tube and a sleeve, wherein an end portion of the inner tube is received in the outer tube, and wherein the sleeve is fit around the inner tube.

* * * * *